US005277796A

United States Patent [19]

Chao

[11] Patent Number: 5,277,796

[45] Date of Patent: Jan. 11, 1994

[54] PRETREATING OIL SHALE WITH ORGANIC ACID TO INCREASE RETORTING YIELD AND PROCESS EFFICIENCY

[75] Inventor: Sherman S. Chao, Indian Head Park, Ill.

[73] Assignee: Institute of Gas Technology, Chicago, Ill.

[21] Appl. No.: 771,164

[22] Filed: Oct. 3, 1991

[51] Int. Cl.[5] ..... C10G 1/00

[52] U.S. Cl. ..... 208/400; 208/403; 208/415; 208/428; 208/435

[58] Field of Search ..... 208/400, 403, 415, 428, 208/435; 201/3, 20; 44/621

[56] References Cited

U.S. PATENT DOCUMENTS

| | | | |
|---|---|---|---|
| 1,605,761 | 11/1926 | Nielsen | 208/428 |
| 4,209,385 | 6/1980 | Stover | 208/254 R |
| 4,587,005 | 5/1986 | Siskin et al. | 208/415 |
| 4,668,380 | 5/1987 | Wolff et al. | 208/435 |
| 5,091,076 | 2/1992 | So et al. | 208/435 |

*Primary Examiner*—Nam Nguyen
*Assistant Examiner*—P. L. Hailey
*Attorney, Agent, or Firm*—Speckman, Pauley & Fejer

[57] ABSTRACT

A process for pretreating oil shale prior to retorting by contacting with an organic acid, such as formic and acetic acids, at temperatures below about 100° C. for a period of time sufficient to react at least a portion of the oil shale carbonates and separating the shale from the organic acid solution containing at least a major portion of the reaction products of the carbonates and organic acid. The process is preferably carried out in an aqueous solution of organic acid having a pH of 3 and less for a time of about ½ to about 4 hours and at ambient temperatures about 20° to about 30° C. Pretreatment of oil shale by this process prior to retorting results in higher liquid and aromatic product fractions being produced by conventional retorting.

33 Claims, No Drawings

PRETREATING OIL SHALE WITH ORGANIC ACID TO INCREASE RETORTING YIELD AND PROCESS EFFICIENCY

BACKGROUND OF THE INVENTION

1. Field of the Invention

This invention relates to pretreating oil shale prior to retorting with organic acid which reduces mineral carbonates content, particularly calcite and dolomite, of the oil shale and increases subsequent retorting yield, particularly, the liquid and aromatic fraction recovery from retorting the organic acid pretreated oil shale. The organic acid pretreatment removes water soluble salts prior to retorting which reduces retorting product oil contamination and hazardous wastes.

2. Description of the Prior Art

Oil shale from both Western and Eastern United States contains mineral carbonates which are desirably removed prior to retorting to increase the oil-retort yield. Mineral acids, such as hydrochloric and sulfuric acid solutions, are known to remove the mineral carbonates from oil shale prior to retorting. Pretreatment of oil shale with mineral acids was reported in Environmental Improvements by Oil Shale Leaching, Mohsen Moussavi and T. F. Yen, in Science and Technology of Oil Shale, edited by T. F. Yen, published by Ann Arbor Science Publisher (1976). Such pretreatment can produce a weight loss of up to 15 percent in Western U.S. oil shale, increasing it's permeability about three orders of magnitude. However, a major drawback of the use of mineral acid is the formation of undesirable, hazardous chlorine and sulfur containing by-products as well as adverse economics.

U.S. Pat. No. 4,396,487 discloses treating oil shale by heating in the presence of steam and acetic acid prior to and after attaining retorting temperatures. The oil shale is heated from an ambient temperature to a final temperature of at least 450° C. for retorting. It is preferred to add about half of the steam and acetic acid during heating and prior to the shale reaching about 120° C. and about half of the steam and acetic acid after the shale has reached about 400° C. The '487 patent teaches that the acetic acid acts as a molecular catalyst which enters into a reaction with the kerogen organic material and converts acetic acid into higher boiling distillable organic material forming a different quality product oil. The '487 patent teaches use of acetic acid in amounts of 1.5% to 3% by weight of the oil shale.

U.S. Pat. No. 4,325,787 teaches an apparatus for retorting oil shale including the introduction of an admixture of steam with acetic acid to the particulate raw material prior to introduction into the retort and in the lower portion of the retort where the temperature is about 500° C. U.S. Pat. No. 2,609,331 teaches a method of pretreating oil shale with hydrogen fluoride or hydrochloric acid to react with aluminum, iron or silicon to produce active catalysts for enhancement of oil production.

U.S. Pat. No. 1,703,192 teaches the digestion of oil shale in a heavy mineral oil at about 700° F. in the presence of a basic material, for example, caustic lime, to liberate nitrogen as ammonia and to bind reactive sulfur present. U.S. Pat. No. 4,545,891 teaches the extraction of kerogen from oil shale by dispersing the oil shale in fused alkali metal caustics as a treating agent for releasing kerogen from the oil shale at a treating temperature of 250° to 400° C. U.S. Pat. No. 4,493,762 teaches the extraction of nitrogen from a shale oil product by sulfuric acid treatment.

U.S. Pat. No. 4,243,511 teaches a method for retorting oil shale utilizing superheated water vapor at temperatures from 425° to 510° C., at a superficial gas velocity of at least 10 cm/sec, and a pressure of about 6.9 to 1034 kPa with maintenance of a carbon dioxide partial pressure sufficient to effectively suppress decomposition of alkaline carbonates to obtain an environmentally acceptable retorted shale. U.S. Pat. No. 3,058,904 teaches a method for retorting oil shale wherein solids up-flow combustion retorting is integrated with hot gas eduction in a fluid-downflow retort with maintenance of the eduction gas above about 0.10 atm. reducing heat loss from carbonate decomposition. The '904 patent recognizes that excessive decomposition of carbonates is a limiting factor in many of the shale retorting methods. U.S. Pat. No. 4,241,951 teaches recovery of magnesium values from inorganic carbonates present in oil shale by introducing oxygen to the trailing side of an advancing combustion zone which decomposes kerogen and coverts magnesium carbonates to oxides and hydroxides which may be leached by contacting with an acidic aqueous leaching agent containing a minor amount of a polyelectrolyte to form an enriched solution containing magnesium values.

SUMMARY OF THE INVENTION

It is an object of this invention to provide a pretreatment process which reduces mineral carbonates content, particularly calcite and dolomite, and reduces inorganic contaminants of oil shale prior to retorting to produce higher yields, cleaner oil products and less undesirable and hazardous waste and by-products.

It is another object of this invention to provide a process for increasing the oil yield and the aromatic fraction produced in retorting oil shale by pretreating the oil shale prior to retorting with an organic acid, such as formic acid or acetic acid, at about ambient temperature to reduce mineral carbonates content, particularly calcite and dolomite, prior to retorting.

It is still another object of this invention to provide a process which can be carried out at low ambient temperatures for pretreatment of oil shale prior to retorting for reduction in mineral carbonate content, thereby reducing the thermal energy required for the oil shale retorting and resulting in environmentally acceptable by-products.

It is yet another object of this invention to provide a process for pretreatment of oil shale prior to retorting for reduction in mineral carbonate content in which the chemical agent used can be readily recovered and recycled to the pretreatment process.

The above objects of this invention and further advantages which will become apparent upon reading the disclosure are achieved by contacting particles of oil shale prior to retorting with organic acids, such as formic acid or acetic acid, at ambient temperatures or temperatures below about 100° C. for a time sufficient to react with at least a portion of the mineral carbonates in the shale. The organic acid is separated from the shale prior to retorting by decantation, centrifugation or filtration resulting in shale for retorting which has a decreased carbonates content. Upon subsequent retorting, the oil shale pretreated according to the process of this invention results in higher carbon conversion and increased liquid and aromatic product fraction recovery, as compared to untreated shale.

The oil shale is preferably pretreated only at ambient temperatures of about 20° to about 30° C. for about ½ to about 4 hours.

In another preferred embodiment, high carbonate content oil shale, such as Western United States oil shale, is additionally contacted with a strong inorganic acid, such as hydrochloric acid, in the pretreatment according to this invention.

In a preferred embodiment, the reaction water and organic acid leachate is reacted with sulfuric acid and distilled to produce a liquid containing the corresponding organic acid which may be recycled to contact fresh oil shale according to the process of this invention.

In another preferred embodiment, carbon dioxide liberated during the organic acid pretreatment can be reduced to carbon monoxide which can be absorbed into a hydroxide solution and subsequently distilled with sulfuric acid to produce formic acid for use in the pretreatment process.

The oil shale treated according to the pretreatment process of this invention has reduced mineral carbonates content, increased porosity and increased surface area providing increased permeability and potential reaction surface area for further reaction. The process of this invention requires very little energy, both thermal and mechanical, and is very economical since the principal treating agent, an organic acid such as formic acid or acetic acid, can be readily and efficiently recovered for recycle to the pretreatment process. In addition to the benefit of producing high purity oil in the subsequent oil shale retorting, the pretreatment process of this invention does not form hazardous or environmentally unacceptable by-products, but to the contrary results in economically beneficial by-products which may be used as de-icing salts for roadways.

DESCRIPTION OF THE PREFERRED EMBODIMENTS

The pretreatment process of this invention may be applied to any type of oil shale for removing mineral carbonates from the oil shale by contacting the shale with a lower molecular weight organic acid, such as formic acid or acetic acid. Western United States oil shales contain higher amounts of mineral carbonates, but Eastern United States oil shales also contain mineral carbonates and may be advantageously pretreated, prior to retorting, according to the process of this invention. The oil shale is riffled and ground to size desired for retorting, under about ⅛ inch average largest dimension. The ground shale may be added to any suitable means for promotion of good liquid/solid contact for contacting with an organic acid. Any type of mixing reactor vessel, including ultrasonic reactors, may be used on a batch basis, or the solid shale particles may be contacted with an organic acid liquid in a solids advancing type reactor, such as a screw reactor on a continuous basis. The organic acid may be in solution form covering the solids or may be continuously or intermittently sprayed on the solids.

The low molecular weight organic acid, preferably formic acid, acetic acid and mixtures of formic and acetic acids, is used in liquid form and is preferably in an aqueous solution having a pH value of less than about 3. Most preferably the pH value of the organic acid aqueous solution is about 2 to about 3. Formic acid and acetic acid are relatively strong organic acids which readily react with oil shale carbonates to form carbon dioxide and water-soluble formate and acetate salts, respectively. In a preferred embodiment of the process of this invention, oil shale is contacted with aqueous organic acid, which produces carbon dioxide and water-soluble organic acid salts. While the invention is described using organic acid in a water solution, any liquid in which the organic acid and the formed mineral salts are soluble may be used. The organic acid solution is used in sufficient amount to make good contact with a major portion of the available mineral carbonates of the oil shale and to provide sufficient acid for reaction with the mineral carbonates. It is suitable to use about 1 to about 100 weight percent of the organic acid solution, based upon the oil shale pretreated. Preferred amounts are about 2 to about 20 weight percent of the organic acid solution, based upon the oil shale pretreated.

Contacting of the organic acid solution and oil shale particles should be carried out for a time sufficient for reaction of the organic acid and mineral carbonates to an extent that the mineral carbonates content of the oil shale is reduced to provide enhanced carbon conversion and enhanced liquid and aromatic product recovery in subsequent retorting. Contacting times of about ½ to about 4 hours are suitable, about 1 to about 3 hours is preferred, depending upon the type of mixing reactor employed. During the contacting of the organic acid solution and oil shale particles, continuous or intermittent agitation should be effected by any suitable means to enhance contact of the oil shale and the organic acid solution. At least periodic agitation is necessary to obtain effective pretreatment within a reasonable time period. Contacting of the oil shale particles with the organic acid solution should be carried out at temperatures below about 100° C., about 5° to about 60° C. being preferred. Ambient temperatures of about 20° to about 30° C. have been found to produce maximum results of the pretreatment process of this invention. Therefore, the pretreatment process of this invention does not require any thermal input and may be conducted as a pretreatment process completely separated from the retorting process.

Organic acids may be readily regenerated and recycled in the pretreatment process of this invention. Unreacted formic acid or acetic acid and formate or acetate salts formed by reaction with the mineral carbonate component of the oil shale are water soluble and thus may be easily separated from the treated oil shale by any liquid/solid separation technique. The unreacted organic acid may be distilled from the separated liquid. The separated liquid containing a major portion of the reaction products of the mineral salts and organic acid may be reacted with sulfuric acid to produce the organic acid for recycle to the process.

The organic acid pretreatment process of this invention may be used in combination with strong inorganic acid, such as hydrochloric acid, for pretreatment at temperatures below 100° C., and preferably ambient temperatures, of either high mineral carbonates content Western United States oil shale or relatively lower mineral carbonates content Eastern United States oil shale. Use of the organic acid in combination with a strong inorganic acid at ambient temperature further increases carbon conversion upon subsequent retorting. Use of an organic acid in combination with hydrochloric acid makes possible use of less expensive inorganic acid without producing the undesired product oil and contaminating by-products produced when using hydrochloric acid alone. Use of the combination of an organic acid and hydrochloric acid appears to result in the formation of inorganic chloride salts as compared to chlorine contamination of the product oils which results when using hydrochloric acid alone. Further, the chloride/formate or chloride/acetate salts formed may be advantageously used as road salt deicing agents.

Pretreatment of oil shale prior to retorting by the process of this invention provides oil shale for subsequent retorting or hydroretorting which results in higher carbon conversion, particularly in oil shales which are recalcitrant to retorting, and increased total liquid recovery with higher aromatic and heavy fractions, as compared to retorting the same non pretreated shale. The liquid product of retorting organic acid pretreated Eastern oil shale according to this invention, using formic or acetic acid, generally contains more aromatics and heavy fractions identified, respectively, by a FTIR spectroscopic technique and the ASTM D2887 simulated distillation technique (boiling point distribution by GC) in accordance with the observed higher middle boiling point of the liquid.

The following examples are set forth in considerable detail and with specific reactants to specifically describe the process of this invention and should not be considered to limit the invention in any way.

EXAMPLE I

One hundred thirty grams of Tennessee Gassaway (Eastern United States) oil shale, previously riffled and ground to 8-20 mesh was contacted with 100 ml 5% aqueous formic acid solution for two hours at ambient temperatures (26°-28° C.) with occasional stirring. The oil shale was separated from the liquid and air dried following which 100 grams of the pretreated oil shale was hydroretorted under a hydrogen pressure of 1000 psig with heating from room temperature to 1000° F. at a heating rate of 23 degrees/minute and maintained at 1000° F.. for 30 minutes. The total recovery of organic carbon from the formic acid pretreated oil shale was 76.9% compared to 67.9% for the same oil shale subjected to the same hydroretorting without any pretreatment. Spectroscopic (FTIR spectroscopic technique) and chromatographic (ASTM D2887 simulated distillation technique of boiling point distribution determination by gas chromotography) analyses of the liquid products showed higher aromatic content in the liquid produced from the formic acid pretreated shale than the untreated shale.

EXAMPLE II

The same oil shale as described in Example I was pretreated using acetic acid instead of formic acid under the same conditions described in Example I followed by hydroretorting under the same conditions described in Example I and resulted in total recovery of organic carbon of 78.2% as compared to 67.9% for the same oil shale subjected to the same hydroretorting without any pretreatment.

COMPARATIVE EXAMPLE III

Colorado (Western U.S.), Indiana-New Albany (Eastern and Tennessee Gassaway (Eastern U.S.) oil shale samples were each riffled, ground to 8-20 mesh, and analyzed for their moisture, carbon, hydrogen and carbonate contents.

In one series of tests 100 grams of each of the above oil shale particles were mixed with 40 ml of 5 weight percent formic acid at ambient temperature of 26°-28° C. and then heated to 105° C. in about 35 minutes. The oil shale was then heated to 120° C. over a period of about 2 hours to drive out water present. Without separation of the formic acid or its products, retorting was then conducted according to the ASTM Fischer Assay Method by raising the temperature to 530° C. over a period of about 2 hours. Carbon was analyzed in the products to calculate the conversion efficiency of each retorting as the percentage of total carbon recovery. A sample of each of the three types of oil shale was subjected to the same retorting treatment without the presence of formic acid. Results are shown in Table 1.

TABLE 1

| Shale Type | Without Formic Acid | With Formic Acid |
|---|---|---|
| Colorado | 56.2 | 58.7 |
| Indiana-New Albany | 36.0 | 39.3 |
| Tennessee Gassaway | 30.0 | 30.3 |

It is noted that the total recovery of organic carbon from the Tennessee Gassaway oil shale retorted in the presence of formic acid according to this Example was 30.3% as compared with 76.9% recovery found with the same oil shale subjected to pretreatment with formic acid according to the present invention as set forth in Example I.

EXAMPLE IV

Three samples of 130 grams of each oil shale identified in Example III were taken and the first of each set of three samples was not subjected to any treatment. The second of each set of three samples was mixed with 100 ml of 5% aqueous formic acid with shaking and stirring for one hour at ambient temperature of 20°-25° C. The third of each set of three samples was mixed with 100 ml of 5% aqueous formic acid with shaking and stirring for one hour at an elevated temperature of 50°-55° C. After liquid/solid separation all shale samples were analyzed for carbon %, carbonate % ($CO_2$%), porosity over 200 angstrom in ml/gm, and the liquid was measured for pH. The analyses results are set forth in Table 2.

TABLE 2

| Shale/ Treatment | Temp. (°C.) | pH | Recovery (Wt. %) | Carbon (%) | $CO_2$ (%) | Pore Vol. (ml/gm) |
|---|---|---|---|---|---|---|
| Colorado/ | | | | | | |
| none | — | — | — | 21.16 | 18.8 | 0.058 |
| formic | 20-25 | 4.6 | 95.9 | 20.95 | 18.44 | 0.107 |
| formic | 50-55 | 4.7 | 95.7 | 21.07 | 18.70 | 0.167 |
| New Alb/ | | | | | | |
| none | — | — | — | 12.75 | 1.60 | 0.054 |
| formic | 20-25 | 3.3 | 96.3 | 12.81 | 0.98 | 0.053 |
| formic | 50-55 | 3.2 | 96.3 | 12.84 | 1.13 | 0.079 |
| Tenn/ | | | | | | |
| none | — | — | — | 12.91 | 1.62 | 0.108 |
| formic | 20-25 | 3.4 | 97.7 | 13.69 | 0.11 | 0.119 |
| formic | 50-55 | 3.4 | 98.0 | 13.70 | 0.19 | 0.140 |

These data show the formic acid pretreatment of oil shale according to the present invention resulted in 2-4 percent removal of mineral, mainly carbonates, significantly increasing the porosity of the oil shale prior to retorting.

EXAMPLE V

One hundred gram samples of each of the three types of oil shale identified in Example III were pretreated with 100 ml of 5% formic acid aqueous solution with agitation for 1 hour prior to hydroretorting. The pretreatment was carried out with a first set of samples at 20° to 25° C. and with a second set of samples at 50° to 55°. The pretreated oil shale was separated from the aqueous formic acid and hydroretorted under conditions described in Example I following which the products were analyzed as described in Example I. The carbon conversions after hydroretorting following pretreatment at 20° to 25° C. were: Colorado—73.9% total carbon; 92.9% organic carbon: Indiana-New Albany—86.7% total carbon; 86.2% organic carbon: Tennessee—77.7% total carbon; 76.9% organic carbon. The carbon conversions after hydroretorting following pretreatment at 50° to 55° C. were: Colorado—73.9% total carbon; Indiana-New Albany—87.2% total carbon; Tennessee —76.3% total carbon.

COMPARATIVE EXAMPLE VI

One hundred gram samples of the three types of oil shale used in Example V were subjected to identical hydroretorting without any pretreatment and the products analyzed in the same manner as in Example V. Hydroretorting untreated samples of oil shale resulted in the following carbon conversions: Colorado—71.8% total carbon; 93.2% organic carbon: Indiana-New Albany—85.5% total carbon; 85.1% organic carbon: Tennessee—69.0% total carbon; 67.9% organic carbon.

EXAMPLE VII

One hundred gram samples of the indicated oil shales were pretreated with 50 ml 5% formic acid aqueous solution by stirring and shaking for 1 hour at 20° to 25° C. Hydroretorting of the pretreated shale under conditions as set forth in Example V resulted in the following total carbon conversions: Indiana-New Albany 88.4%; Tennessee 76.3%.

EXAMPLE VIII

One hundred gram samples of Indiana-New Albany oil shale were pretreated at 20° to 25° C. by agitation for 1 hour with 100 ml aqueous solution of 4 weight percent hydrochloric acid and 1 weight percent acetic acid in one case and 1 weight percent formic acid in a second case following which the pretreated oil shale was hydroretorted under the conditions set forth in Example V. The resulting total carbon conversion was 88.2% and 86.9%, respectively, as compared to 85.5% for the same oil shale without any pretreatment.

While in the foregoing specification this invention has been described in relation to certain preferred embodiments thereof, and many details have been set forth for purpose of illustration, it will be apparent to those skilled in the art that the invention is susceptible to additional embodiments and certain details described herein can be varied considerably without departing from the basic principles of the invention.

I claim:

1. A process for pretreating oil shale prior to retorting comprising the steps of: contacting particles of said oil shale not subjected to prior chemical treatment with an organic acid selected from the group consisting of formic acid, acetic acid and mixtures thereof in liquid form and at temperatures below about 100° C.; continuing said contacting said shale and said organic acid for a time sufficient to react with a portion of the mineral carbonates contained in said shale to form carbon dioxide and soluble acid salts; and separating pretreated shale prior to retorting from reaction liquid comprising said organic acid and at least a major portion of said soluble acid salt reaction products of said mineral carbonates and said organic acid, thereby reducing the mineral carbonates content and increasing the porosity of said shale.

2. A process according to claim 1 wherein said mineral carbonates comprise carbonates selected from the group consisting of calcite, dolomite and mixtures thereof.

3. A process according to claim 2 wherein said organic acid is an aqueous organic acid comprising at least one of formic acid and acetic acid and having a pH value of about 3 and less.

4. A process according to claim 3 wherein said pH is about 2 to about 3.

5. A process according to claim 3 wherein said aqueous organic acid is used in an amount of said organic acid of about 1 to about 100 weight percent of said oil shale.

6. A process according to claim 5 wherein said aqueous organic acid is used in an amount of said organic acid of about 2 to about 20 weight percent of said oil shale.

7. A process according to claim 5 wherein said temperature is about 5° to about 60° C.

8. A process according to claim 7 wherein said temperature is ambient and about 20° to about 30° C.

9. A process according to claim 7 wherein said contacting is carried out with at least periodic agitation and for about ½ to about 4 hours.

10. A process according to claim 9 wherein said contacting is carried out for about 1 to about 3 hours.

11. A process according to claim 1 wherein aqueous formic acid is used in an amount of about 2 to about 20 weight percent of said oil shale.

12. A process according to claim 1 wherein said contacting is carried out only at temperatures about 5° to about 60° C.

13. A process according to claim 1 wherein said contacting is carried out at temperatures about 20° to about 30° C.

14. A process according to claim 1 wherein said contacting is carried out with at least periodic agitation and for about ½ to about 4 hours.

15. A process according to claim 1 further comprising contacting said oil shale with hydrochloric acid in combination with said organic acid.

16. A process according to claim 15 wherein said organic acid comprises at least one of formic and acetic acids.

17. A process according to claim 1 comprising using carbon dioxide formed during said organic acid contacting to reduce to carbon monoxide which is then absorbed into a hydroxide solution and distilled with sulfuric acid to produce formic acid and recycling said formic acid produced to said contacting of said oil shale.

18. A process according to claim 1 comprising distilling said reaction liquid and recycling recovered organic acid to said contacting.

19. A process according to claim 18 wherein said reaction liquid is reacted with sulfuric acid prior to said distilling.

20. In a process for production of organic hydrocarbons from oil shale by retorting, the improvement comprising: pretreating particles of said oil shale not subjected to prior chemical treatment by contacting with an organic acid selected from the group consisting of formic acid, acetic acid and mixtures thereof in liquid form and at temperatures below about 100° C.; continuing said contacting said shale and said organic acid for a time sufficient to react with a portion of the mineral carbonates contained in said shale to form carbon dioxide and soluble acid salts; and separating reaction liquid comprising organic acid and at least a major portion of said soluble acid salt reaction products of said mineral carbonates and said organic acid from the pretreated shale particles, thereby reducing the mineral carbonates content and increasing the porosity of said shale, the subsequent retorting of said pretreated shale particles resulting in increased liquid and aromatic product fraction recovery, compared to untreated shale.

21. In a process according to claim 20 wherein said organic acid is an aqueous organic acid comprising at least one of formic acid and acetic acid and having a pH value of about 3 and less.

22. In a process according to claim 21 wherein said aqueous organic acid is used in an amount of said organic acid of about 1 to about 100 weight percent of said oil shale.

23. In a process according to claim 22 wherein said temperature is about 5° to about 60° C.

24. In a process according to claim 23 wherein said temperature is ambient and about 20° to about 30° C.

25. In a process according to claim 23 wherein said contacting is carried out with at least periodic agitation and for about ½ to about 4 hours.

26. In a process according to claim 20 wherein an aqueous solution of formic acid is used in an amount of about 2 to about 20 weight percent of said oil shale.

27. In a process according to claim 20 wherein said contacting is carried out only at temperatures about 5° to about 60° C.

28. In a process according to claim 20 wherein said contacting is carried out at temperatures about 20° to about 30° C.

29. In a process according to claim 20 wherein said contacting is carried out with at least periodic agitation and for about ½ to about 4 hours.

30. In a process according, to claim 20 further comprising contacting said oil shale with hydrochloric acid in combination with said organic acid.

31. In a process according to claim 28 comprising using carbon dioxide liberated during said organic acid contacting to reduce to carbon monoxide which is then absorbed into a hydroxide solution and distilled with sulfuric acid to produce formic acid and recycling said formic acid produced to said contacting of said oil shale.

32. In a process according to claim 20 comprising distilling said reaction liquid and recycling recovered organic acid to said contacting.

33. In a process according to claim 32 wherein said reaction liquid is reacted with sulfuric acid prior to said distilling.

* * * * *